US005787691A

United States Patent [19]

Turfan et al.

[11] Patent Number: 5,787,691

[45] Date of Patent: *Aug. 4, 1998

[54] APPARATUS FOR WRAPPING ARTICLES IN PLASTIC FILM

[75] Inventors: Faruk M. Turfan; Normand Boyer, both of Quebec, Canada; Thomas M. Oleksy, Chesterfield, Mo.

[73] Assignee: Newtec International S.A., Aix-Les-Bains, France

[ * ] Notice: The term of this patent shall not extend beyond the expiration date of Pat. Nos. 5,517,807 and 5,590,476.

[21] Appl. No.: 739,701

[22] Filed: Oct. 29, 1996

Related U.S. Application Data

[62] Division of Ser. No. 482,909, Jun. 8, 1995, abandoned.

[51] Int. Cl.[6] ..... B65B 13/04; B65B 53/00

[52] U.S. Cl. ..... 53/588; 53/556

[58] Field of Search ..... 53/556, 588, 210

[56] References Cited

U.S. PATENT DOCUMENTS

| | | | |
|---|---|---|---|
| 4,587,796 | 5/1986 | Haloila | 53/588 |
| 4,619,193 | 10/1986 | Crew | 53/588 X |
| 4,829,753 | 5/1989 | Bricmont | 53/588 |
| 4,850,177 | 7/1989 | Kaczkowski et al. | 53/588 X |
| 4,905,448 | 3/1990 | Plitt | 53/588 X |
| 4,939,989 | 7/1990 | Zacharias | 53/588 X |
| 5,155,970 | 10/1992 | Moore | 53/588 X |
| 5,184,449 | 2/1993 | Hannen | 53/558 X |
| 5,390,476 | 2/1995 | Morantz | 53/556 |
| 5,517,807 | 5/1996 | Morantz | 53/588 X |

FOREIGN PATENT DOCUMENTS

| | | | |
|---|---|---|---|
| 2058377 | 6/1993 | Canada | 53/588 |
| 47739 | 11/1973 | Finland . | |

*Primary Examiner*—Linda Johnson
*Attorney, Agent, or Firm*—Schwartz & Weinrieb

[57] ABSTRACT

Apparatus for wrapping articles in film material includes a stationary frame supporting a vertically reciprocable frame which in turn supports a rotatable ring member carrying a film carriage assembly by which film is wrapped around a load during rotation of the ring member. The ring member is a cast composite ring of a thermosetting, fiberglass reinforced polyester and comprises a flange by which the ring member is supported for rotation and a body portion on which the film carriage and slip ring members are mounted.

20 Claims, 7 Drawing Sheets

APPARATUS FOR WRAPPING ARTICLES IN PLASTIC FILM

This patent application is a Divisional patent application of prior patent application Ser. No. 08/482.909 filed Jun. 8, 1995, now abandoned.

BACKGROUND OF THE INVENTION

The present invention relates in general to the art of apparatus for packaging articles in plastic film material, and more particularly, to improvements in such apparatus with respect to the support and displacement of a film carriage about articles to be wrapped.

One form of apparatus to which the improvements according to the present invention are applicable is disclosed in U.S. Pat. Nos. 4,587,796 to HALOILA and 5,390,476 to MORANTZ, the disclosures of which are hereby incorporated by reference herein for background purposes. The apparatus disclosed in these patents includes a stationary frame for receiving an article or load to be wrapped, a vertically reciprocable frame supported on the stationary frame, and a ring member supported on the reciprocating frame for displacement therewith and for rotation relative thereto about a vertical ring axis. The ring member carries a film carriage assembly by which film is wrapped around a load during rotation of the ring member.

Heretofore, the ring member in such wrapping apparatus has been of metal construction fabricated from two matching pieces suitably secured together and machined in an effort to obtain the necessary accuracy and profile for rotating the ring at an acceptable speed with respect to achieving a desired wrapping rate. For all the effort in this respect, however, the ring is often out-of-round and/or not flat with respect to a plane transverse to the ring axis, and these problems limit the speed at which the ring can be rotated and thus the wrapping rate of the apparatus. Moreover, the ring generally has web and flange portions by which the ring is supported for rotation and, as a result of the out-of-round and non-flat problems, tracking of the ring relative to the rollers and wheels which support the ring for rotation is not good, and this too reduces the speed at which the ring can be rotated. Still further, the ring supports commutator or slip ring members by which electrical power is delivered to the carriage assembly during operation of the apparatus, and the foregoing problems with regarding the contour of the metal ring member cause relative bouncing between the moving, slip rings, and the fixed brush contacts therefor. Such bouncing causes arcing between the commutator rings and brushes, again limiting the speed at which the ring member can be rotated. Moreover, such bouncing increases the wear between and decreases the life of slip rings and brush contacts, thus increasing maintenance cost and time with respect to the apparatus.

The weight of the metal ring members, which are generally made from steel or aluminum, supplements the foregoing problems with respect to contour and the affect of contour on ring speed. Especially in this respect, the weight of the metal rings affects the acceleration and deceleration rates of the ring with respect to a wrapping operation and, thus, the wrapping rate at which the apparatus can be operated. Still further, all of the foregoing problems are attendant to the use of metal rings with another form of wrapping apparatus in which the vertically reciprocable frame carrying the ring member is mounted in cantilever fashion relative to the stationary frame. With this apparatus configuration, additional problems result from the weight of the ring. In this respect, the cantilever arrangement imposes undesirable bending forces between the stationary and reciprocating frames, thus requiring a more rigid interengaging support arrangements and/or a counterweight arrangement and/or a positioning of the reciprocating frame relative to the stationary frame to shorten the length of the cantilever arm relative to the stationary frame. The latter arrangement reduces the diameter of the ring member which can be used with the apparatus and, thus, the peripheral size of a load which can be wrapped by the apparatus.

SUMMARY OF THE INVENTION

In accordance with the present invention, an improved ring member construction is provided by which the foregoing and other problems relating to film wrapping apparatus heretofore available are minimized or eliminated. More particularly, in this respect, a ring member according to the invention is cast from plastic material which, preferably, is filler reinforced. Casting of the ring member from plastic material advantageously enables obtaining a higher degree of accuracy than heretofore possible with respect to the peripheral contour of the ring member. Casting also enables obtaining a flat ring member and flat ring member surfaces which are cooperable with the film carriage and/or reciprocating frame for supporting the film carriage for displacement about the ring axis during a wrapping operation. Thus, in connection with mounting the film carriage on the ring member for rotation therewith relative to the reciprocating frame, the round and flat contour of the composite ring provides for the latter to be rotated at higher speeds then heretofore possible by minimizing tracking problems and bouncing between the commutator strips and brush elements.

Furthermore, such higher speed operation is enhanced by the fact that the ring member is of considerably better quality with respect to dimensional and contour accuracy than a metal ring member of corresponding diameter, and such quality provides for faster acceleration and deceleration of the ring member during a wrapping operation, and thus a reduction of wrapping time. Still further, the molded plastic ring member is cheaper to construct than a metal ring member of corresponding size and, advantageously, the plastic material can have a color imparted thereto during the manufacturing process, thus to eliminate the need for painting heretofore required in connection with metal rings. Another advantage resides in the fact that the casting of the ring member from plastic material assures consistency with respect to roundness and flatness from one ring member to another. Yet another advantage resides in the fact that the ring member can be provided with a non-circular contour, such as an ellipse for example, which enables the ring member to be fixed relative to the reciprocating frame and for the carriage to be mounted on the ring member for displacement thereabout, thereby enabling the wrapping of a long and narrow load as opposed to the wrapping of a square load with a round ring member. The accuracy with respect to roundness and flatness of a composite ring which enables the higher wrapping speed then heretofore possible also provides for increasing the reliability and performance level of the apparatus in conjunction with reducing the wrapping time with respect to a given load and increasing the production rate of the apparatus as measured in loads per hour.

It is accordingly an outstanding object of the present invention to provide improved film wrapping apparatus of the character comprising a stationary frame, a vertically reciprocating frame carrying a ring member which in turn supports a film carriage, and wherein the reciprocating frame, ring member and film carriage are structurally interrelated for the film carriage to be displaced about a load coaxial with the ring member to achieve wrapping of the load in plastic film.

Another object is the provision of apparatus of the foregoing character with an improved ring member which enables operation of the apparatus at a higher wrapping speed than heretofore possible.

A further object is the provision of apparatus of the foregoing character with an improved ring member which enables faster vertical and rotational acceleration and deceleration in conjunction with displacing the film carriage about a load, whereby the wrapping time for a given size apparatus is reduced.

Yet another object is the provision of apparatus of the foregoing character with a ring member of composite plastic material which, advantageously, is more economical to produce than a metal ring member of the same circumferential dimension and is more accurate with respect to peripheral contour and flatness than ring members heretofore available.

BRIEF DESCRIPTION OF THE DRAWINGS

The foregoing objects, and others, will in part be obvious and in part pointed out more fully hereinafter in conjunction with a written description of preferred embodiments of the invention illustrated in the accompanying drawings in which.

DESCRIPTION OF PREFERRED EMBODIMENTS

Figure 1:
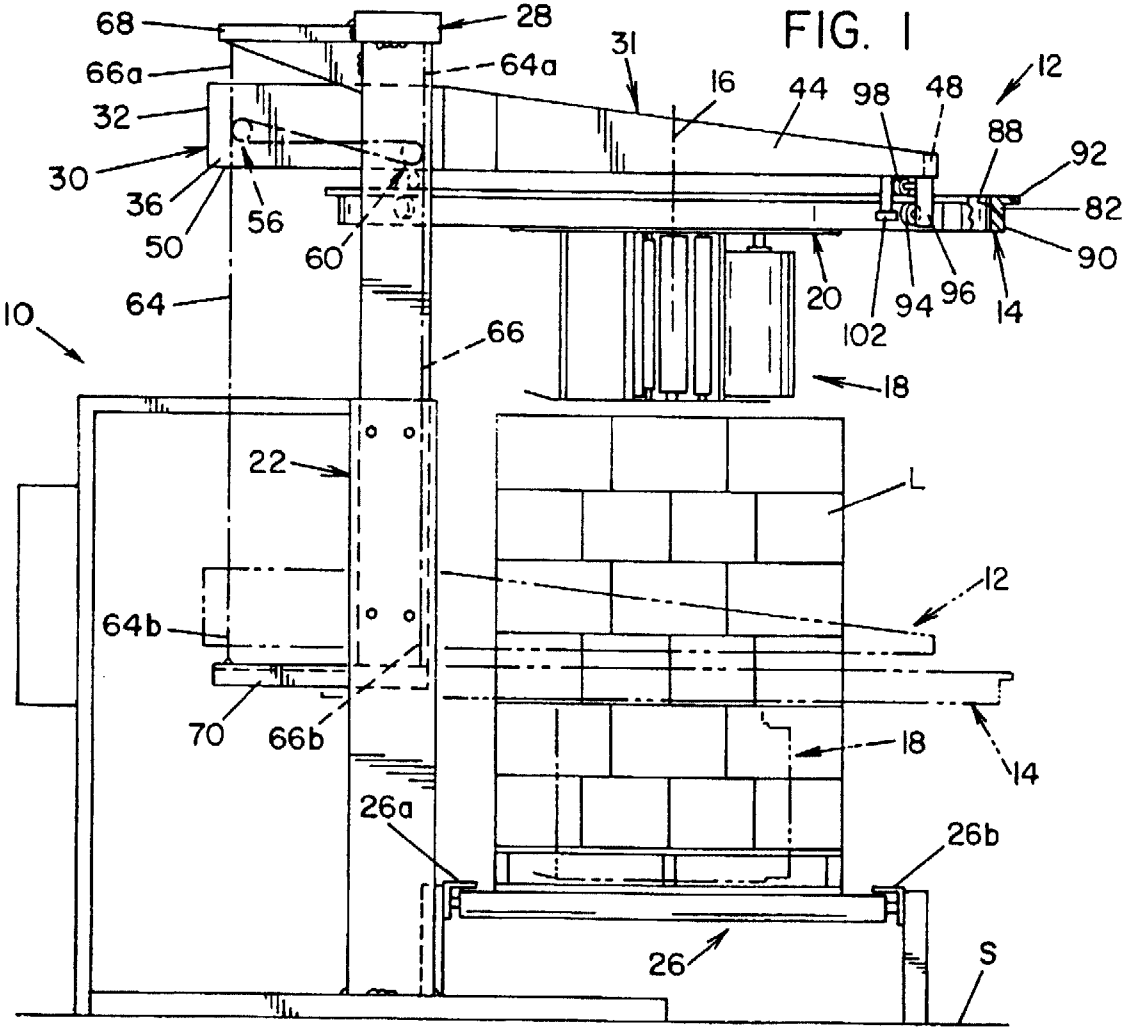
FIG. 1 is an end elevation view of wrapping apparatus having an improved ring member in accordance with the present invention.

Referring now in greater detail to the drawings wherein the showings are for the purpose of illustrating preferred embodiments of the invention only and not for the purpose of limiting the invention, one embodiment of wrapping apparatus including an improved ring member in accordance with the present invention is illustrated in FIGS. 1–8 and comprises a stationary frame 10 and a frame 12 supported on frame 10 for vertical displacement relative thereto. A ring member 14 in accordance with the present invention and which is described in greater hereinafter is supported on frame 12 for vertical displacement therewith and for rotation relative thereto about a vertical ring axis 16. A film carriage assembly 18 is mounted on ring member 14 by means of a mounting bracket 20 and, accordingly, is rotatable and vertically displaceable therewith. Stationary frame 10 is supported on an underlying surface S and, basically, comprises a pair of vertical posts 22 and 24 adjacent laterally inner side **26*a* of a conveyor 26 for supporting a load L at a wrapping station of the apparatus which is generally coaxial with axis 16. Posts 22 and 24 are longitudinally spaced apart and connected at their top ends by a cross member 28**.

Reciprocating frame 12 comprises an inner frame portion 30 which extends between posts 22 and 24, and an outer frame portion 31 which extends outwardly across conveyor 26 and has an outer end adjacent outer side **26*b* of the conveyor. Frame portion 30 includes a pair of laterally spaced apart longitudinally extending side members 32 and 34 interconnected at one of the opposite ends thereof by end members 36 and 38 and interconnected at the other ends thereof by end members 40 and 42. Outer frame portion 31 includes a pair of longitudinally spaced apart end members 44 and 46 extending laterally outwardly from side member 34 of frame portion 30, and a longitudinally extending side member 48 between the laterally outer ends of end members 44 and 46. Frame portion 31 supports ring member 14** as described in greater detail hereinafter.

Inner frame portion 30 includes a bottom wall 50 upon which a motor and gear reduces drive unit 52 is suitably mounted for rotating a longitudinally extending shaft 54 which is rotatably supported between end members 38 and 42 of frame portion 30. Drive unit 52 is operable through shaft 54 to vertically reciprocate frame 12. More particularly in this respect, the opposite ends of shaft 54 are provided with sprocket wheel units 56 and 58 for rotation therewith, and either idler wheel units 60 and 62 are mounted on frame portion 30 in lateral alignment with units 56 and 58, respectively. A pair of link chains 64 and 66 are trained about sprocket units 56 and 60 and have corresponding upper ends **64*a* and 66*a* fastened to cross member 28 of frame 10 and a support 68 extending rearwardly therefrom. Chains 64 and 66 have lower ends 64*b* and 66*b*, respectively, fastened to a support member 70, extending rearwardly from post 22 of stationary frame 10. Similarly, a pair of link chains 72 and 74 are trained around sprocket units 58 and 62 and have upper ends 72*a* and 74*a* fastened to frame 10 in the same manner as the upper ends of chains 64 and 66, and having lower ends 72*b* and 74*b* connected to a support member 76 which is the same as support member 70 and is attached to post 24 of frame 10. It will be appreciated that the manner in which the several chains are trained about the sprocket units provides for frame 12 to reciprocate vertically in response to operation of drive unit 52 in opposite directions. It will be further appreciated that the manner in which the several chains are trained about the sprocket units provides the necessary reaction to entirely support the overhung load represented by the cantilever arrangement of reciprocating frame 12 with respect to frame 10. The reciprocation of frame 12 relative to stationary frame 10 is guided by interengaging guidance arrangements 78 between frame posts 22 and 24 of frame 10 and end members 36 and 40 of portion 30 of frame 12. Bottom wall 50 of frame portion 30 also supports a motor and gear reducer drive unit 80 by which ring member 14 is rotated relative to frame 12** as set forth more fully hereinafter.

Figure 2:
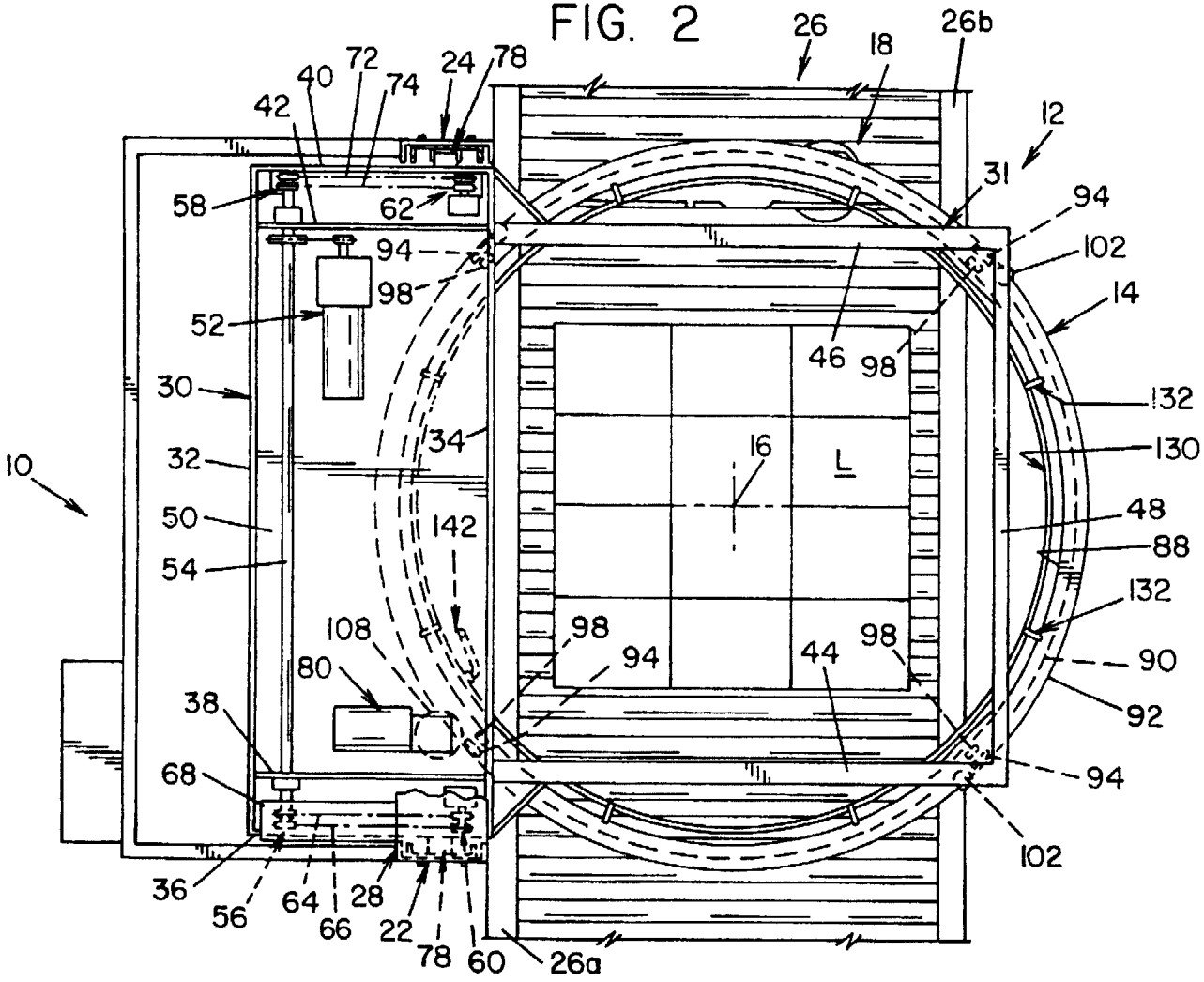
FIG. 2 is a plan view of the apparatus shown in FIG. 1.
Figure 3:
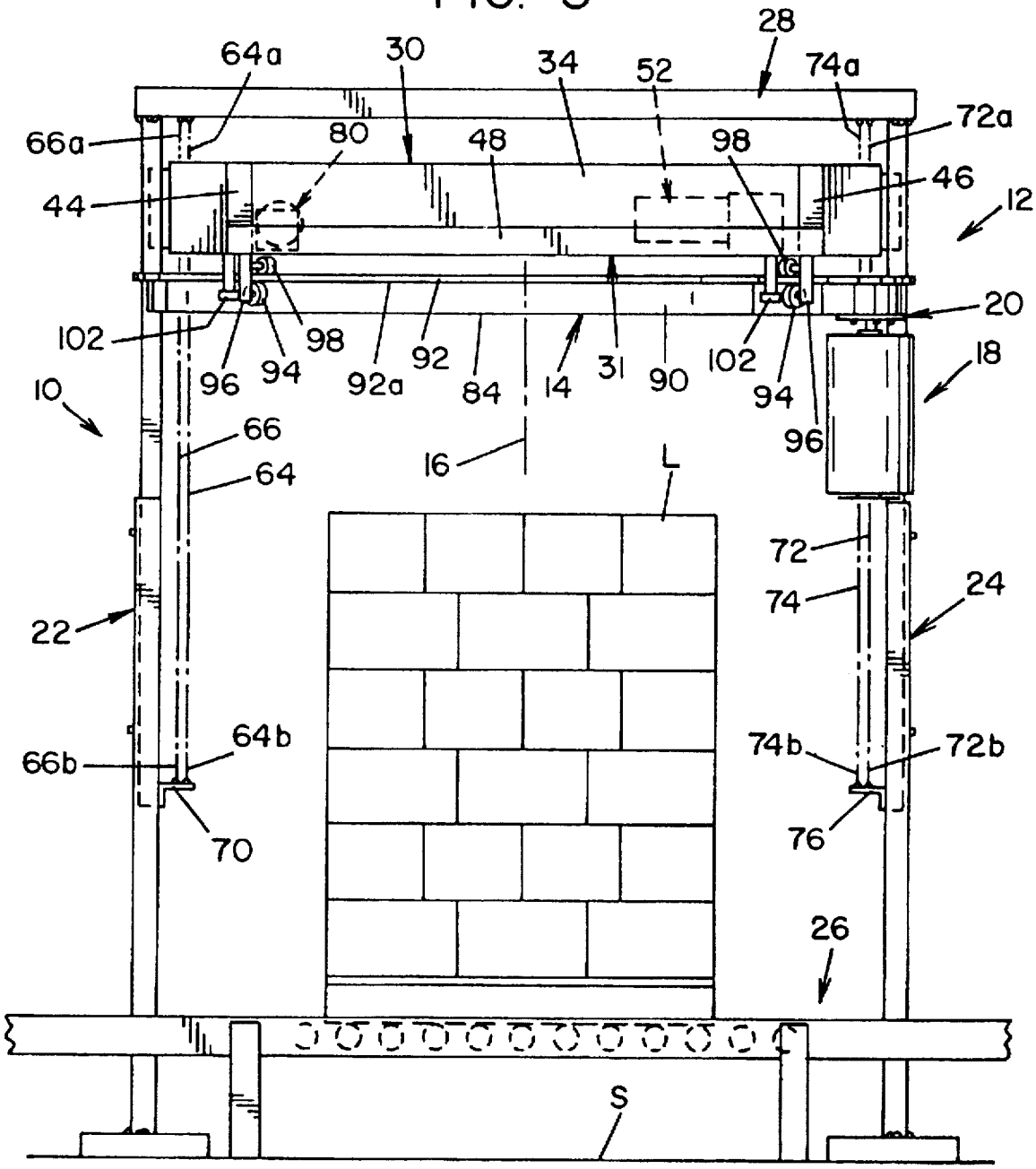
FIG. 3 is a side elevation view of the apparatus show in FIG. 1.

Referring now in particular to FIGS. 4–8 in conjunction with FIGS. 1–3, ring member 14 in accordance with the present invention is constructed from cast plastic material which, preferably, is a fiberglass reinforced polyester. In the embodiment illustrated, ring member 14 is circular with respect to ring axis 16 and, in cross-section, is of inverted L-shape. More particularly, ring member 14 comprises a body portion 82 having a lower end 84, an upper end 86, and radially inner and outer sides 88 and 90, respectively. The ring member further includes a flange 92 extending radially outwardly from and about body portion 82 at the upper end thereof. As will be best appreciated from FIGS. 4 and 6, ring member 14 is vertically supported for rotation relative to frame 10 by a plurality of wheels 94 mounted on frame 12 by corresponding support brackets 96 for rotation about horizontal axes, not designated numerically. Wheels 94 are circumferentially spaced apart relative to ring member 14 and engage the under side 92*a* of flange 92. Preferably, as will be appreciated from FIGS. 1–3, a plurality of rollers 98 are mounted on frame members 44, 46, and 48 of frame 12 by corresponding brackets 100 and are rotatable about horizontal axes so as to be in rolling engagement with upper end 86 of body portion 82 of ring member 14. These rollers in cooperation with wheels 94 provide vertical stability for ring member 14 during rotation thereof about axis 16.

As will be appreciated from FIGS. 2, 4, 5, and 7, ring member 14 is further supported for rotation about axis 16 relative to frame 12 by a plurality of circumferentially spaced apart wheels 102, 106, and 108 supported on frame 12 in rolling engagement with radially outer side 90 of body portion 82 of ring member 14. Wheel 106 is mounted on bottom wall 50 by means of a mounting bracket 110, and wheel 108 is a drive wheel by which ring member 14 is rotated relative to frame 12. More particularly in this respect, as will be appreciated from FIGS. 2 and 5, drive unit 80 has an output shaft 112 extending downwardly through an opening 114 therefor in bottom wall 50 of frame portion 30, and wheel 108 is mounted on shaft. 112 for rotation therewith. At least the outer surface of drive wheel 108 is of rubber or the like to provide for frictional engagement thereof with body portion 82 of ring member 14. Accordingly, rotation of drive wheel 108 in opposite directions about the axis of shaft 112 provides for rotating ring member 14 in opposite directions about axis 16 thereof.

The foregoing wheel support arrangement stabilizes ring member 14 during rotation thereof advantageously provides for faster acceleration, deceleration and wrapping speed then heretofore possible with metal ring members, while maintaining stability of the ring against bouncing. The foregoing acceleration, deceleration, speed, and non-bouncing are also attributable to the molding of the ring member from plastic material which enables obtaining desired flatness and roundness of the ring relative to axis 16 and the plane of flange 92.

Figure 4:
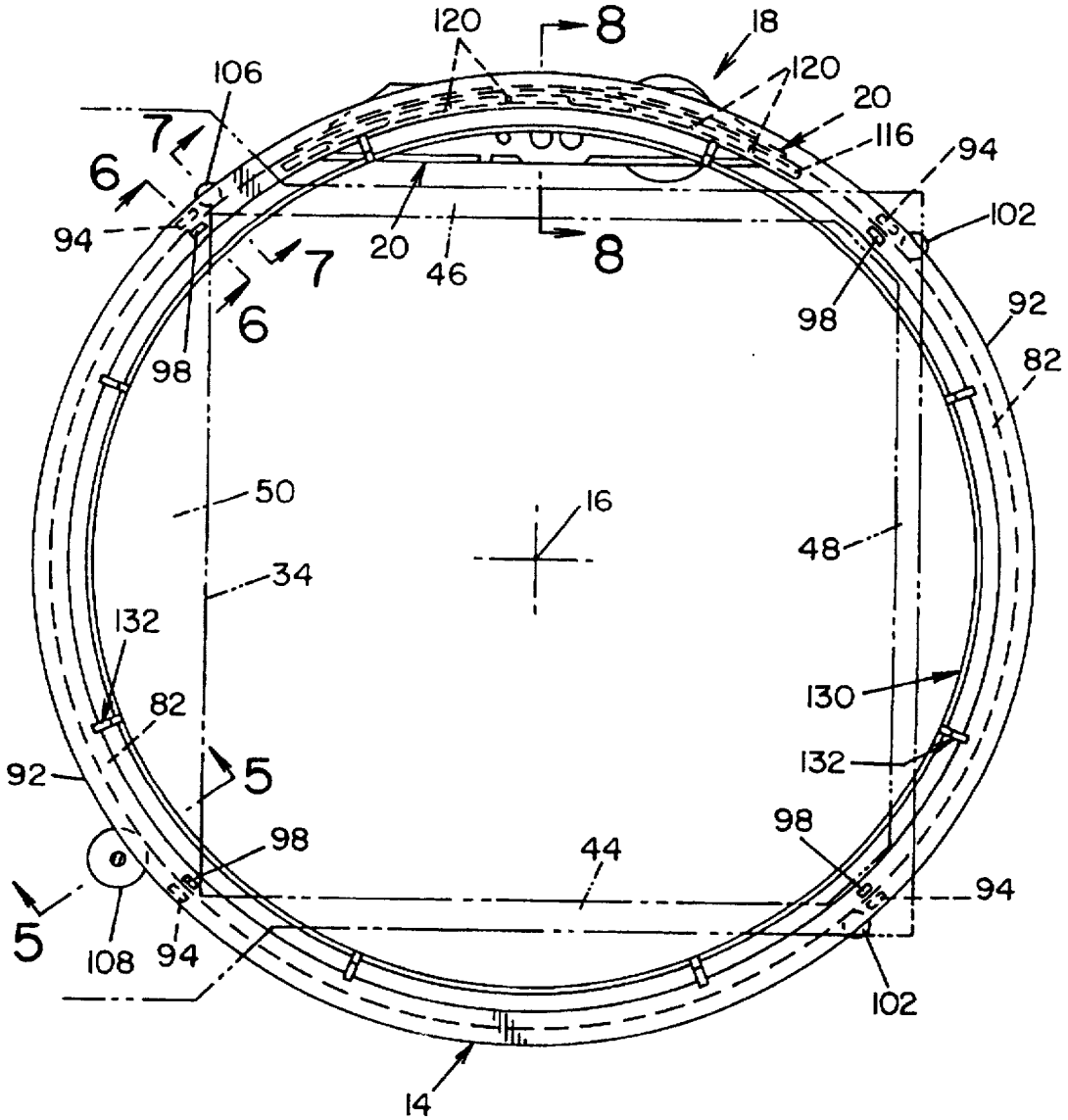
FIG. 4 is a plan view of the ring member for the apparatus shown in FIG. 1.
Figure 8:
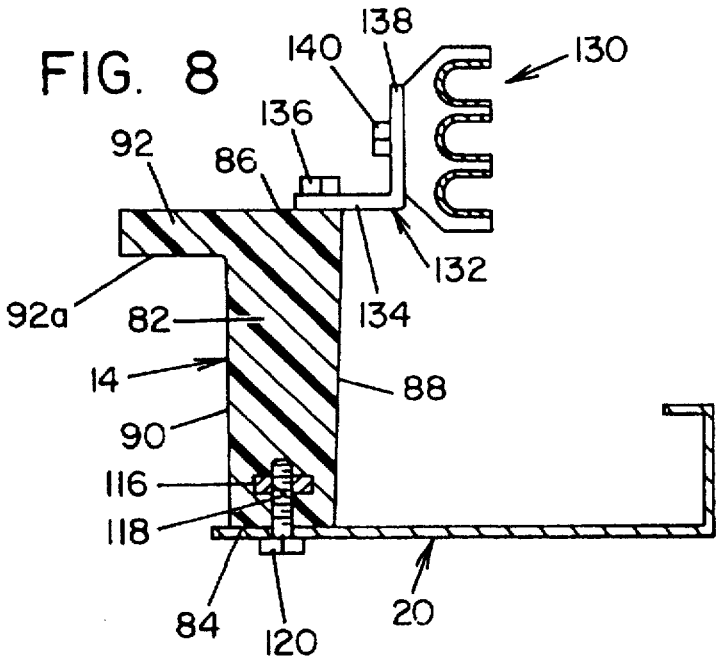
FIG. 8 is a cross-sectional elevation view of the ring member taken along line 8—8 in FIG. 4.

As mentioned above, film carriage 18 is mounted on ring member 14 for rotation therewith by means of a mounting bracket 20, and in the embodiment illustrated such mounting is achieved by embedding a steel mounting plate 116 in body portion 82 of ring member 14 as shown in FIG. 8 of the drawing. Mounting plate 116 is a planer member which follows the contour of the ring member and which, as best seen in FIG. 4, has an angular extent of about 60° relative to axis 16. Plate member 116 is provided with a plurality of threaded openings 118 along the length thereof for receiving threaded fasteners 120 by which mounting bracket 20 and thus film carriage 18 is securely mounted to body portion 82 of the ring member.

As is well known in connection with wrapping apparatus of the foregoing character, the radially inner side of the ring member is provided with an annular slip ring assembly for conducting electricity to film carriage 18, and reciprocating frame 12 is provided with a brush contact assembly which slidably interengages with the slip ring assembly for conducting electricity to film carriage 18 from a source which is connected to the brush assembly. In the embodiment illustrated, as best seen in FIGS. 2 and 5–7, such a brush assembly 130 is mounted on ring member 14 by means of a plurality of L-shaped brackets 132 having a bottom leg 134 by which the bracket is attached to top end 86 of the ring member through the use of threaded fasteners 136. Bracket 132 further includes an upwardly extending leg 138 to which the slip ring assembly is fastened through the use of threaded fasteners 140. Legs 138 of brackets 132 support the slip ring assembly radially inwardly adjacent inner side 88 of ring member 14 which enhances high speed rotation of the ring member without arcing between the slip ring assembly and the contact brush unit 142 which is mounted on frame 12 for engagement with the slip ring assembly.

Figure 9:
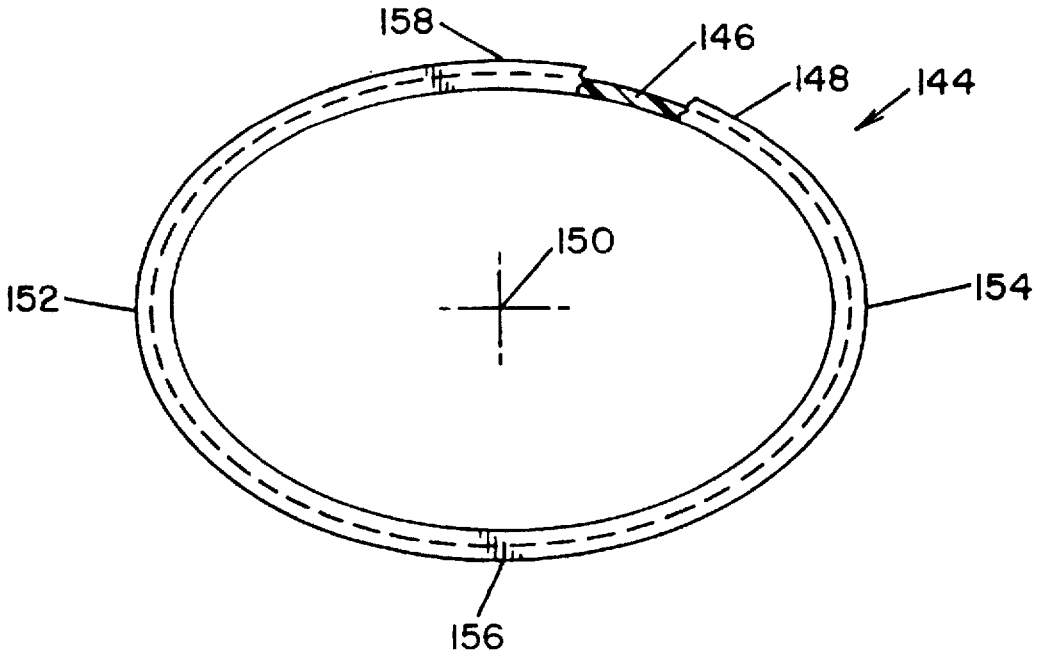
FIG. 9 is a plan view of another embodiment of a ring member according to the present invention.

Referring now to FIG. 9 of the drawing, there is illustrated a further embodiment of a ring member according to the present invention for use in plastic film wrapping apparatus. In FIG. 9, the ring which is designated generally by the numeral 144 is preferably cast from a filler reinforced plastic to provide a body portion 146 and flange 148, respectively, corresponding to body portion 82 and flange 92 of ring member 14 described hereinabove. In this embodiment, ring 144 has an axis 150 and an elliptical contour thereabout which provides for the ring to have a major dimension through center 150 between opposite ends 152 and 154 and to have a minor dimension through center 150 between opposite sides 156 and 158. The casting of a ring member from plastic material in accordance with the present invention enables obtaining extreme accuracy with respect to contour and dimensions as well as providing for the economical production of a non-round ring such as that shown in FIG. 9. Furthermore, such a non-round ring configuration enables supporting the ring relative to a reciprocating frame such as frame 12 in the embodiment described above, against rotation relative to the frame, and configuring the ring member in cross sections to displacably support a film carriage assembly. Thus, a film carriage assembly can be displaced about the periphery of the ring member and, as will be appreciated from FIG. 9, the elliptical configuration would enable the packaging of a load having a greater length than width.

Figure 10:
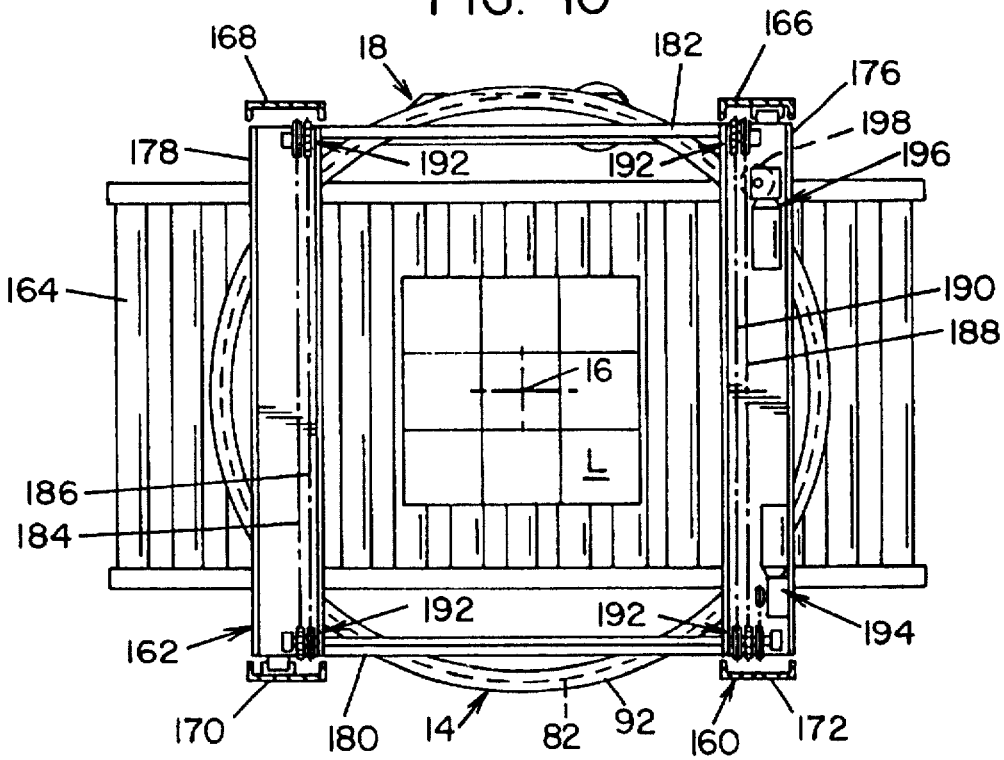
FIG. 10 is a plan view of another embodiment of wrapping apparatus including the ring member shown in FIGS. 4–8.
Figure 11:
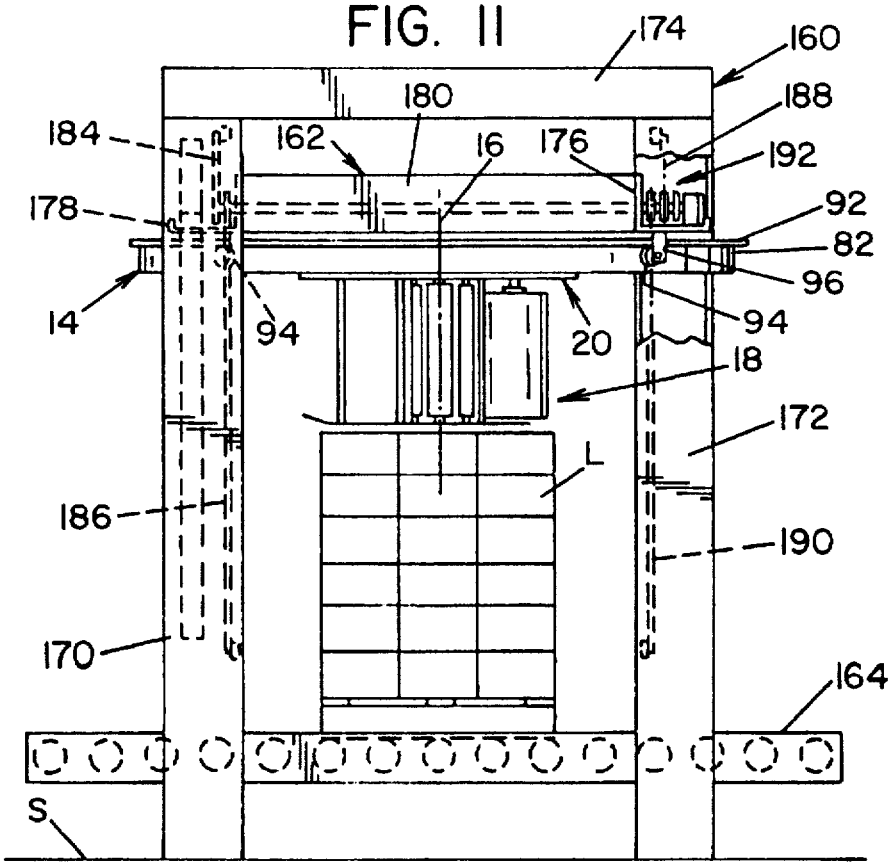
FIG. 11 is a side elevation view of the apparatus shown in FIG. 10.

Referring now to FIGS. 10 and 11 of the drawing, there is illustrated a further embodiment of wrapping apparatus in accordance with the present invention incorporating ring member 14 as described hereinabove. The apparatus illustrated in FIGS. 10 and 11 is similar to that described in detail in the aforementioned patent to MORANTZ, whereby reference may be had to the latter patent for a more detailed description of the apparatus which will be described herein only to the extent necessary for an understanding of the present invention. The wrapping apparatus illustrated in FIGS. 10 and 11 comprises a stationary frame 160, a frame 162 which is supported on frame 160 for vertical displacement relative thereto, and ring member 14 which is supported on frame 162 for vertical displacement therewith and for rotation relative thereto about vertical ring axis 16. Stationary frame 160 is supported on underlying surface S and spans a conveyor 164 by which a load L to be wrapped is moved into position within the apparatus. In this embodiment, frame 162 is comprised of four upright corner posts 166, 168, 170, and 172, a cross member 174 between posts 170 and 172, and a corresponding cross member, not shown, between posts 166 and 168. While not shown, the stationary frame further includes cross members between the upper ends of posts 168 and 170 and between posts 166 and 172. Reciprocating frame 162 is comprised of end members 176 and 178 respectively extending between posts 166 and 172 and between posts 168 and 170, and side members 180 and 182 respectively interconnecting the ends of end members 176 and 178 adjacent posts 170 and 172 and adjacent posts 166 and 168 of the stationary frame.

A plurality of link chains 184, 186, 188, and 190 are associated with corresponding pairs of sprocket wheel units 192 adapted to be driven in unison by a motor and gear reduction drive unit 194 mounted on frame member 176 of the reciprocating frame. Operation of the drive unit in opposite directions results in elevating and lowering frame 162 relative to stationary frame 160. Frame member 176 of reciprocating frame 162 further supports a motor and gear reduction drive unit 196 for rotating a drive wheel 198 by which ring member 14 is rotated about axis 16 as described hereinabove in conjunction with the embodiment illustrated in FIGS. 1–8. Further, ring member 14 is supported for rotation relative to reciprocating frame 162 in the manner illustrated in the latter figures, such support thus including wheels 94 underlying flange 92 of ring member 14 and mounted on reciprocating frame 162 by mounting brackets 96.

Figure 5:
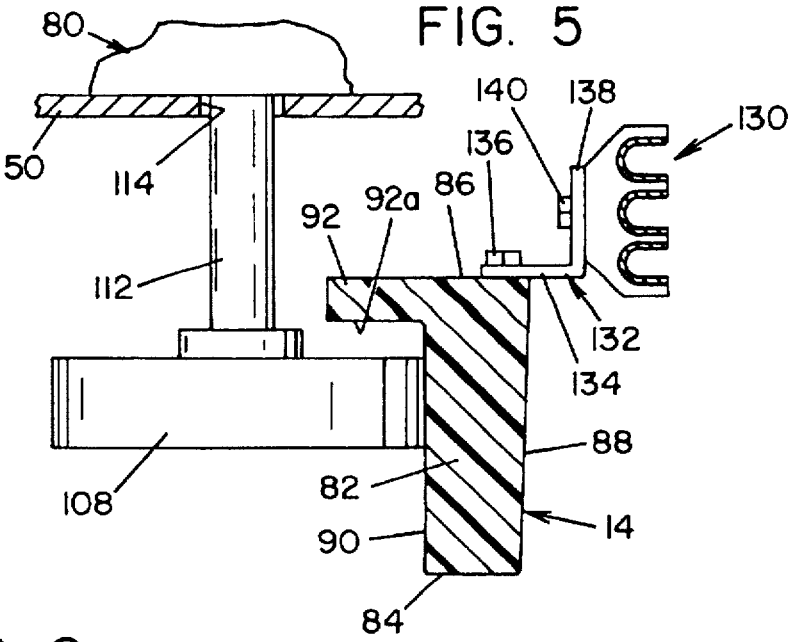
FIG. 5 is a cross-sectional elevation view of the ring member taken along line 5—5 in FIG. 4.
Figure 6:
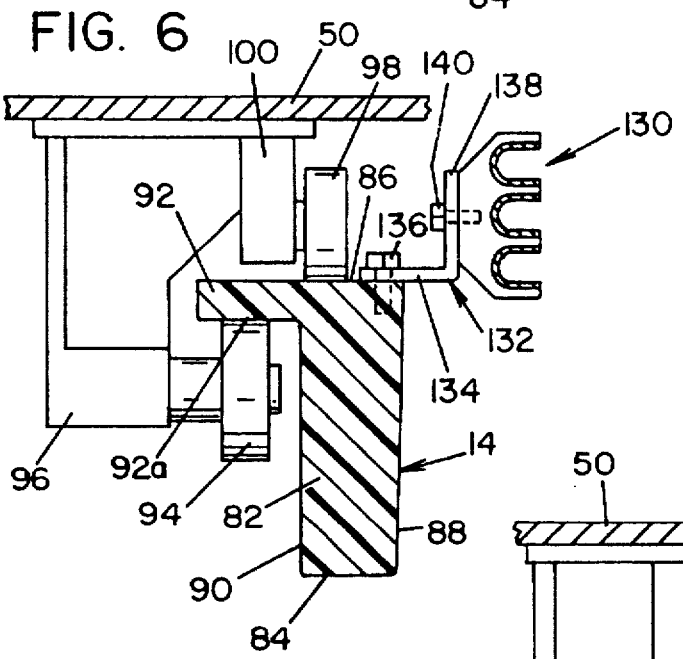
FIG. 6 is a cross-sectional elevation view of the ring member taken along line 6—6 in FIG. 4.
Figure 7:
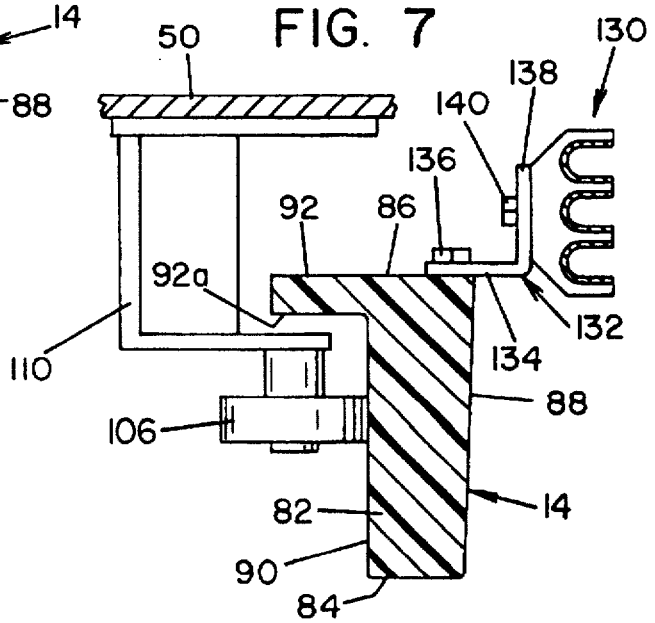
FIG. 7 is a cross-sectional elevation view of the ring member taken along line 7—7 in FIG. 4.

As mentioned above, ring member 14 is of the structure shown in detail in FIGS. 4–8 of the drawing, whereby it will be appreciated that annular slip rings, not shown in FIGS. 10 and 11, are mounted on ring member 14 as described herein in conjunction with FIGS. 5–7. Likewise, it will be appreciated that a film carriage assembly 18 is mounted on ring member 14 by means of a mounting bracket 20 and in the manner described herein in conjunction with FIG. 8 of the drawing.

As mentioned herein, ring member 14 is cast as a composite of plastic material and a strengthening filler therein. While a number of mineral or cellulose fillers may provide desired characteristics for the ring member, fiberglass is preferred in that it provides optimum strength and dimensional stability for the ring member. Likewise, while a number of plastic materials may provide desirable characteristics, it is preferred to use a thermosetting, fiberglass reinforced polyester having a relative density of 1.4, a modulus of elasticity of 1,000,000 psi and a tensile strength of 15,000 psi. In the embodiments illustrated in FIGS. 1–8, 10 and 11 of the drawing, ring member 14 is circular and has an inner diameter at the upper end of radially inner side 88 thereof of about 88 11/16 inches, and has an outer diameter defined by flange 92 of about 96 13/16 inches. With respect to the cross-sectional configuration of the ring member, the latter has an axial height between ends 84 and 86 of about 4.06 inches and a radial width across upper side 86 and flange 92 of about 4.06 inches. Flange 92 has an axial thickness of about 0.63 inch and extends radially outwardly from body portion 82 about 1.56 inches. Body portion 82 has a radial thickness adjacent to the underside of flange 92 of about 2.50 inches, and radially inner side 90 converges toward radially outer side 88 from upper end 86 toward bottom end 84 of body portion 82 at an angle of about 2°. Steel film carriage mounting plate 116 has an axial thickness of about 0.25 inch and a radial width of about 1.50 inch and a circumferential length of about 48 inches which provides for the mounting strip to have an angular extent of about 60° with respect to ring axis 16. Mounting strip 116 is embedded radially centrally in body portion 82 of the ring member and axially inwardly from lower end 84 of the body portion for the lower side of the mounting strip facing end 84 to be spaced about 0.50 inch therefrom.

While considerable emphasis has been placed herein on the structure and structural interrelationship between the component parts of the preferred embodiments of the invention, it will be appreciated that other embodiments can be made and that changes can be made in the preferred embodiments without departing from the principles of the present invention. In this respect, for example, other slip ring mounting arrangements can be provided, such as mounting the slip rings directly on the radially inner side of the ring member, or embedding the slip rings in the material of the ring member. Similarly, other arrangements can be provided for mounting the film carriage assembly on the ring member, and other arrangements can be provided for supporting the ring member for rotation relative to the reciprocating frame. Still further, drive arrangements other than through the use of a rotating friction wheel can be devised and in this respect, for example, casting of the ring member from plastic material would enable providing the ring member with gear teeth about the periphery thereof to facilitate rotation of the ring by a driven pinion. It will be appreciated too that the composite ring can be used to considerable advantage with horizontal wrapping in which the ring axis is horizontally oriented. These and other modifications of the embodiments disclosed herein as well as other embodiments of the invention will be obvious and suggested to those skilled in the art, whereby it is to be distinctly understood that the foregoing descriptive matter is to be interpreted merely as illustrative of the present invention and not as a limitation.

We claim:

1. Apparatus for wrapping a load in film material, comprising:

first frame means for defining a wrapping station for receiving a load to be wrapped;

second frame means vertically reciprocable relative to said first frame means and a load to be wrapped which is disposed at said wrapping station;

means for reciprocating said second frame means relative to said first frame means and a load to be wrapped which is disposed at said wrapping station;

ring means comprising a vertically extending web having an inner side and an outer side, and a horizontally extending peripheral flange;

means, for supporting said ring means upon said second frame means for vertical displacement therewith and for rotation relative to said second frame means about a vertical axis, comprising a plurality of wheels mounted upon said second frame means, angularly spaced apart about said vertical axis, rotatable about horizontal axes, and disposed beneath said horizontally extending peripheral flange of said ring means;

film carriage means mounted upon said ring means and having a roll of film material disposed thereon for wrapping said film material about a load to be wrapped, disposed at said wrapping station, during rotation of said ring means relative to said second frame means and about said vertical axis; and means, for rotating said ring means about said vertical axis, comprising at least one wheel mounted upon said second frame means, rotatable about a vertical axis, and in frictional engagement with only said outer side of said vertically extending web of said ring means.

2. Apparatus according to claim 1, wherein:

said wrapping station has laterally opposite sides;

said first frame means includes a pair of vertical posts disposed adjacent to one of said sides of said wrapping station; and said second frame means extends across said wrapping station from said pair of vertical posts in a cantilevered manner so as to have an unsupported outer end which is disposed adjacent to the other one of said opposite sides of said wrapping station.

3. Apparatus according to claim 1, wherein:

said vertically extending web of said ring means has upper and lower ends and said horizontally extending peripheral flange extends radially outwardly from said upper end of said vertically extending web such that said ring means has a substantially inverted L-shaped cross-sectional configuration.

4. Apparatus according to claim 3, wherein said flange has an axial thickness and said web has a radial thickness greater than said axial thickness.

5. Apparatus according to claim 1, further comprising:

means for mounting said film carriage means upon said ring means wherein said mounting means comprises a carriage mounting strip embedded within said web adjacent to said lower end thereof.

6. Apparatus according to claim 1, wherein: means for rotatably supporting said ring means further includes a plurality of wheels mounted upon said second frame means and radially engaging said outer side of said web.

7. Apparatus according to claim 1, wherein:

said at least one wheel comprises a drive wheel; and means are provided upon said second frame means for rotating said drive wheel so as to rotate said ring means.

8. Apparatus according to claim 1, further comprising:

electrical conductor means, for said film carriage means, mounted radially inwardly adjacent to said inner side of said ring means; and means provided upon said second frame means for connecting said conductor means with a source of electrical power.

9. Apparatus according to claim 8, wherein:

said electrical conductor means comprises slip ring means extending about said inner side of said ring means; and said means for connecting said electrical conductor means with a source of electrical power comprises brush means mounted upon said second frame means for sliding engagement with said slip ring means.

10. Apparatus as set forth in claim 1, wherein:

said ring means comprises a plastic material.

11. Apparatus as set forth in claim 10, wherein:

said plastic material comprises a thermosetting, fiberglass reinforced polyester.

12. Apparatus as set forth in claim 2, further comprising:

drive means defined between said first frame means and said second frame means for enabling said second frame means to be vertically reciprocated with respect to said first frame means and for supporting said cantilevered second frame means in a counterbalanced manner upon said first frame means.

13. Apparatus as set forth in claim 12, wherein:

said drive means comprises link chain means having opposite ends thereof fixedly secured to said first frame means, and sprocket means mounted upon said second frame means and about which said link chain means are routed.

14. Apparatus as set forth in claim 13, wherein:

said link chain means comprises two pairs of link chains fixedly connected to opposite ends of said first frame means; and said sprocket means comprises two pairs of sprocket wheels operatively associated with each pair of said two pairs of link chains.

15. Apparatus as set forth in claim 13, wherein:

portions of said link chain means routed about said sprocket means are routed about said sprocket means so as to have a substantially figure-8 configuration whereby said second frame means is able to be supported upon said first frame means in said counterbalanced manner.

16. Apparatus as set forth in claim 14, wherein:

said two pairs of sprocket wheels operatively associated with a particular one of each pair of link chains are spaced with respect to each other in the direction in which said second frame means extends in said cantilevered manner across said wrapping station and away from said pair of vertical posts of said first frame means.

17. Apparatus as set forth in claim 14, wherein:

each one of said two pairs of link chains is disposed upon a lateral side of said first frame means such that said two pairs of link chains are disposed upon opposite lateral sides of said first frame means; and said two pairs of sprocket wheels operatively associated with a particular one of each pair of link chains are spaced from each other in a horizontal direction which extends transversely to a direction extending between said opposite lateral sides of said first frame means.

18. Apparatus as set forth in claim 17, wherein:

said sprocket means comprises four pairs of sprocket wheels with two pairs of sprocket wheels disposed adjacent to each one of two opposite lateral sides of said second frame means.

19. Apparatus as set forth in claim 18, further comprising:

a drive shaft operatively interconnecting one of said two pairs of sprocket wheels disposed adjacent to each one of said opposite lateral sides of said second frame means; and motor drive means mounted upon said second frame means and operatively connected to said drive shaft for driving both of said one of said two pairs of sprocket wheels disposed adjacent to each one of said opposite lateral sides of said second frame means.

20. Apparatus as set forth in claim 14, wherein:

each one of said two pairs of link chains is disposed upon a lateral side of said first frame means such that said two pairs of link chains are disposed upon opposite lateral sides of said first frame means; and said two pairs of sprocket wheels operatively associated with a particular one of each pair of link chains are mounted upon a lateral side of said second frame means such that a first set of said two pairs of sprocket wheels operatively associated with one of said two pairs of link chains is disposed opposite a second set of said two pairs of sprocket wheels operatively associated with a second one of said two pairs of link chains.

* * * * *